United States Patent [19]

Wood

[11] 4,134,234

[45] Jan. 16, 1979

[54] WEATHER STRIP AND BALANCE ASSEMBLY FOR NONREMOVABLE WINDOWS

[75] Inventor: Edward H. Wood, Sanford, N.C.

[73] Assignee: Celotex Corporation, Tampa, Fla.

[21] Appl. No.: 874,412

[22] Filed: Feb. 2, 1978

[51] Int. Cl.[2] ..... E05D 13/10

[52] U.S. Cl. ..... 49/429; 16/197; 49/445

[58] Field of Search ..... 49/429, 430, 445, 446; 16/197

[56] References Cited

U.S. PATENT DOCUMENTS

| | | | |
|---|---|---|---|
| 3,046,618 | 7/1962 | Teggelaar | 49/445 X |
| 3,058,176 | 10/1962 | Zegers | 49/429 X |
| 3,116,520 | 1/1964 | MacGregor | 49/429 X |
| 3,147,517 | 9/1964 | Dinsmore | 49/429 X |
| 3,375,610 | 4/1968 | Beasley, Jr. et al. | 49/445 |
| 3,633,317 | 1/1972 | Koebel | 49/430 |

*Primary Examiner*—Philip C. Kannan

*Attorney, Agent, or Firm*—Schroeder, Siegfried, Ryan, Vidas & Steffey

[57] ABSTRACT

This invention relates to an improved weather strip and balance assembly for nonremovable windows in which the weather strip is made of a compressable, high impact material with ridges thereon to mount the sash. The ridges also mount and enclose the balance springs and pulley blocks with the sash cord coupled thereto for counter-balancing the weight of the sash. The sash cord is directed out from behind the weather strip through an opening therein to connect to the sash through an anchor. The length of the sash cord at the connection of the sash is adjustable to adjust the tension of the balance system applied to the sash. The assembly is readily assembled in said jambs of a window frame by securing the same thereto, such as by screws. The assembly is manufactured, shipped and stored without tension thereon to eliminate warpage and displacement of parts.

16 Claims, 7 Drawing Figures

WEATHER STRIP AND BALANCE ASSEMBLY FOR NONREMOVABLE WINDOWS

FIELD AND BACKGROUND OF INVENTION

The present invention relates to a weather strip and balance assembly for a nonremovable window and more particularly to an improved assembly of this type which is unitary in construction and which may be readily manufactured and installed.

In the manufacture and assembly of windows of varying types, it is conventional to make the balance assembly for counterbalancing the weight of the sash as a unitary structure and to provide various types of weather strip on the jamb of the window frame for guiding and sealing the sash thereto. Normally, such structures are independent of one another and result in relatively complex installation problems. Where such assemblies are installed at the point of manufacture, handling and shipping of the complete window units will frequently break or damage the weather seal. When the weather strip and balance assemblies are installed at the point of usage, the installation problems become complex and chances for uniformity in the weather strip seal to the sash is diminished. The use of separate weather strip and balance assemblies generally require different sized components to provide for the adjustment to varying weights of sash. This increases the size and number of components to be manufactured and stored by a manufacturer and dealer with a resultant increase in the cost of the same. In addition, with such on site installations, the effectiveness of the seals of the weather strip to the sash are not uniformly controlled.

SUMMARY OF PRESENT INVENTION

The present invention relates to a simplified design of a weather strip and balance assembly which enables ease in manufacturing and installation. It further permits interchangability of spring parts or sash cord adjustments for varying weights of sash and for different types of sash. The improved weather strip and balance assembly is a composite unit which is manufactured and shipped without stress thereon so as to prevent warpage of the same. Further, the composite unit permits universal application of the same. The balance assembly is connected as an integral part of the weather strip so that the complete assembly may be installed at the point of usage merely by applying the sash thereto and securing the same to a window frame jamb with the connection of the sash cords to the sash. The adjustability of the springs is obtained by using different sized springs and varying the connection of the sash cord to a sash. This permits a universal application of the same with varying weights of sash and with the assurance that the weather strip will make a positive weather seal with the sash.

DESCRIPTION OF PREFERRED EMBODIMENT

Figure 1:
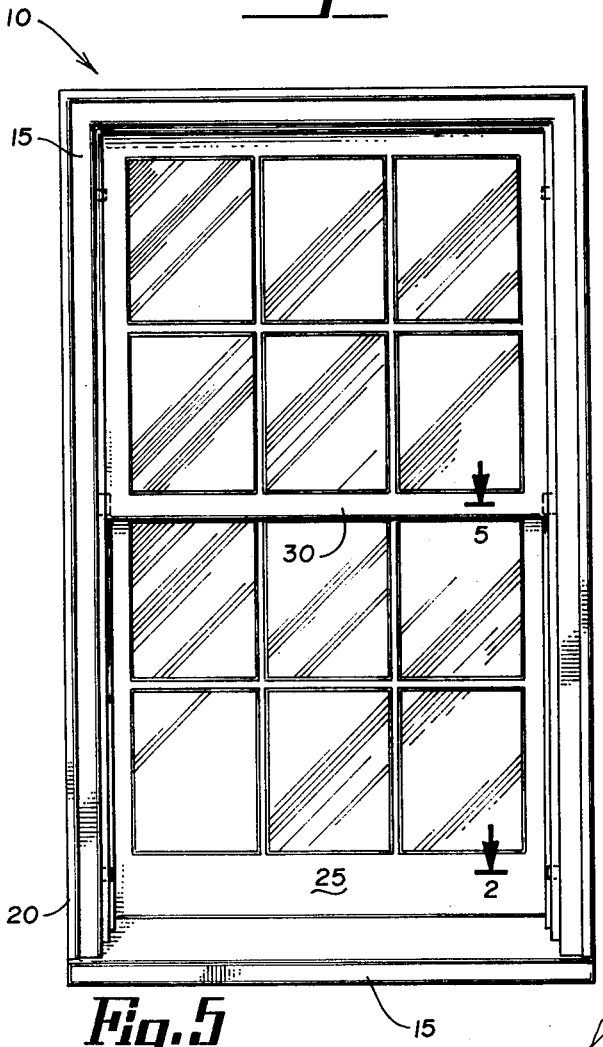
FIG. 1 is an elevation view of a double hung window employing my improved weather strip and balance assembly.

My improved weather strip and balance assembly for nonremovable window is shown in FIG. 1 in connection with a double hung window, indicated generally at 10. The window includes a frame 15 having side jamb surfaces 17 on the vertical side edges of the same on which the sash is positioned. Suitable trim pieces, such as stops and molding, indicated generally at 20, are applied over the outer edge of the window to define the jamb surfaces and cover the same. The window frame is adapted to mount a pair of sash, indicated at 25 and 30 respectively.

The sash 25 and 30 are mounted in the window frame through jamb liners, indicated generally at 40, which slidably mount the sash for movement along the side jamb surfaces 17 and seal to the vertical edges of the sash. The jamb liner 40 include a balance system to counterbalance the weight of the sash as will be hereinafter noted.

Figure 3:
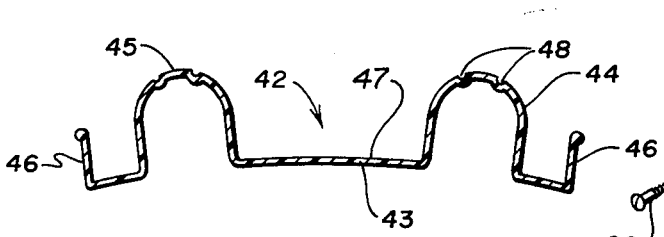
FIG. 3 is a cross sectional view of the weather strip without the balance assembly applied thereto.

Each jamb liner includes a weather strip member 42 which is positioned on each of the jamb surfaces 17 of frame 15 and extend the full height thereof. FIG. 3 shows a cross section of the weather strip member 42. This weather strip member may be made of any semi-rigid plastic material, such as polyvinyl, having a high impact characteristic or thin flexible metal. It may be extruded or rolled in the form shown in the cross section to incorporate a generally bowed base configuration 43 and a pair of raised and curved or rounded projecting ridges 44, 45 with a recessed center portion 47. The weather strip member has edges 46 which are bent generally normal to the curve of the base 43 in a direction of the ridges. The ridges 44 and 45 each have ribbed channels, such as is indicated at 48, extending along the curved face of the ridge for strength and decoration purposes. The space behind each ridge, 44, 45, which is defined by the sides and curved face of the same, is generally square in cross section and serves to house the balance system as will be hereinafter noted. The curved or rounded surfaces of the ridges mount the sash 25 and 30 which have elongated grooves 54, 55 extending along the side styles of the same. The sash 25 and 30 are mounted on the ridges 44, 45 of the weather strip and a bowed configuration of the weather strip permits flexing of the same to provide mounting the sash thereon with a seal between the ridges of the weather strip and the grooves of the sash. The grooves 54, 55 in the sash are conventional and serve the purpose of mounting the sash on the jamb liner and guiding the same for movement in the window frame. The improved weather strip configuration with its ridges 44, 45 thereon, is designed to mount varying types of sash and varying weights of sash with conventional grooving therein.

The weather strip 42, as will be seen in FIG. 3, has a center recessed portion 47 or parting area between the projections or ridges 44, 45. Because of the bowed configuration of the weather strip, this area is offset from the bent edges 46 of the same and allows not only compressive movement of the weather strip as the sash is mounted thereon but slight translational movement to fit the ridges to the grooves in the sash so that the ridges may seal to the same. The weather strip is made of a material which is flexible and with spring characteristics such that it will return to its original shape applying a positive seal to the sash at the ridges thereof upon installation of the sash.

Figure 4:
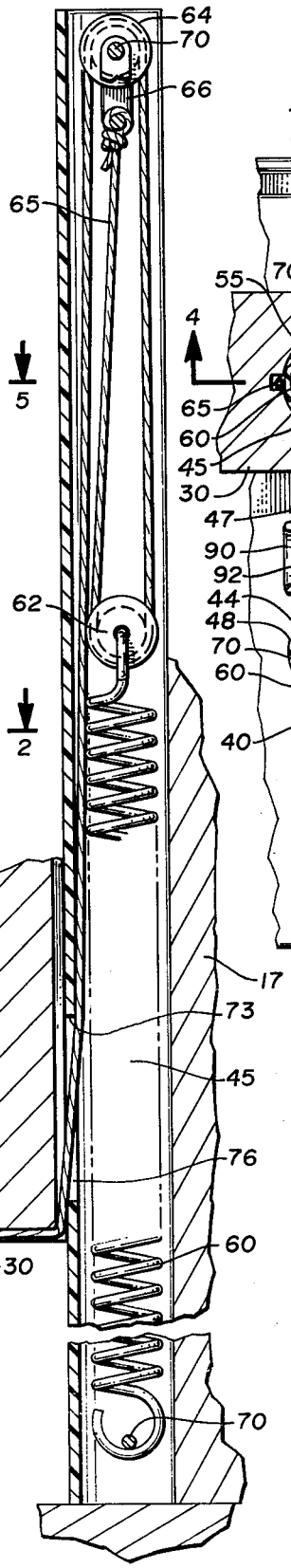
FIG. 4 is a sectional view of the weather strip and balance assembly taken along the lines 4—4 in FIG. 2 and extending the entire height of the window frame.
Figure 2:
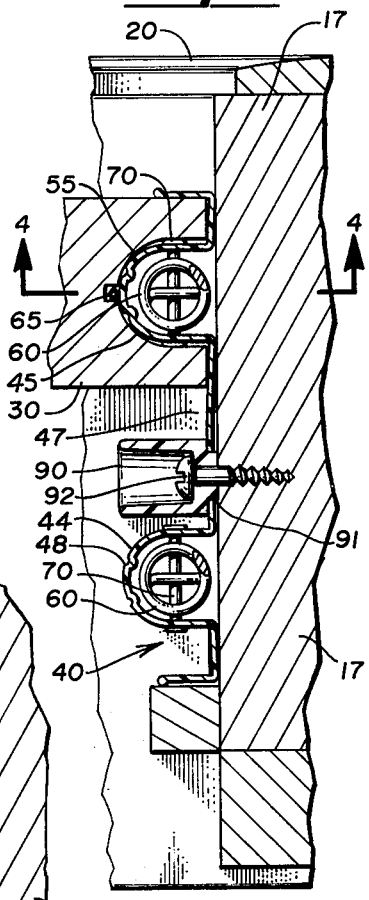
FIG. 2 is a sectional view of the weather strip and balance assembly of FIG. 1 taken along the lines 2—2 therein and with parts broken away.

The balance system for the sash is comprised of springs 60 mounted within the ridges 44, and 45 of the weather strip, each spring having pulleys 62 and 64 and a sash cord 65, with the sash cord extending over the pulleys to apply tension of the spring to the sash to which it is connected. Each balance system is mounted within the weather strip by rivets 70 which extend through the side of the ridges 44 and 45 at the upper and lower edges thereof. The lower extremity of the weather strip has one end of the spring in each ridge positioned over a rivet extending through the respective ridge, as seen in FIG. 4. The opposite end of the weather strip has similar rivets 70 extending through the sides of the ridges 44, 45 which mount the pulleys 64 in each of the ridges. The pulleys 62 are attached to the ends of the springs 60 remote from their connection to the rivets 70, and the sash cord extends from a hook 66 on the pulleys 64 and over the pulley 62 on the end of the spring with the cord being directed back over the pulley 64 to apply and direct the tension of the spring to the sash. The same construction is applied to each ridge of the weather strip and for each side of the window frame to mount the sash on each side thereof.

The ends of the sash cords are brought out through openings 76 in the ridges 44, 45 in the weather strip. These openings 76 are positioned intermediate the extent of the weather strip 42 and in a position where they will always be covered by the sash. The openings 76 are elongated and the ends 73 of the openings (See FIG. 4) are constructed with a smooth surface (not shown), so that movement of the sash cord 65 over these surfaces will not cause the sash cord to fray or tear. The free ends of each sash cord each mount an anchor 80 which is tied thereto. The anchor is adapted to be screwed or press fitted into the bottoms of each sash on each side thereof in a suitable hole 83 positioned in a groove 82 in the bottom of each sash. The length of each sash cord at the anchor 80 may be adjusted to apply a proper tension from the balance assembly to the sash to counter-balance the weight of the same, as will be hereinafter noted.

Figure 5:
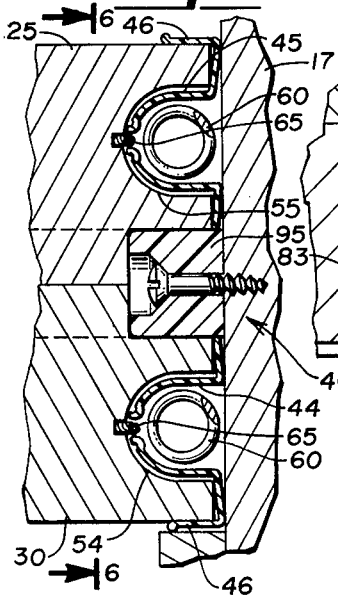
FIG. 5 is a sectional view of the weather strip and balance assembly taken along the lines 5—5 in FIG. 1 and with parts broken away.
Figure 5:
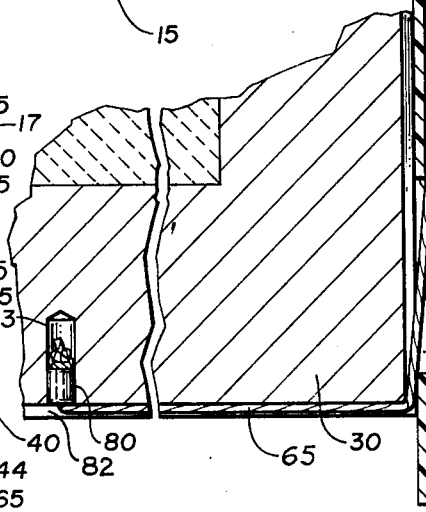
Figure 6:
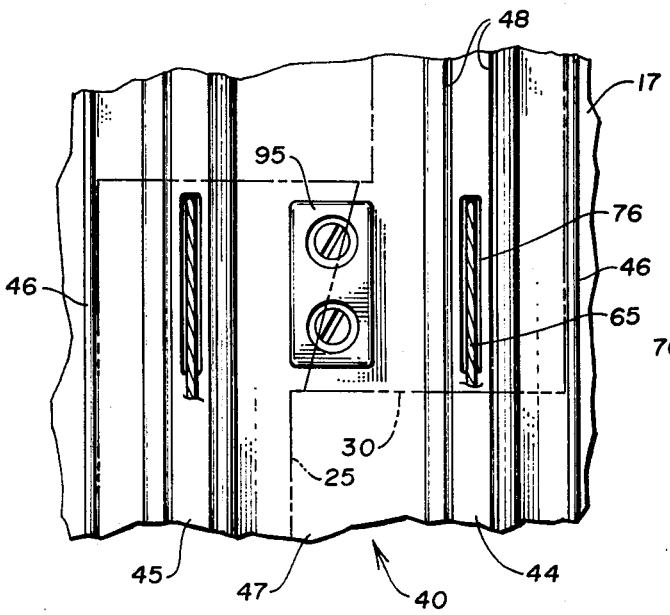
FIG. 6 is a sectional view of the weather assembly taken along the lines 6—6 in FIG. 5, with parts in phantom; and, FIG. 7 is a perspective view of the improved weather strip and balance assembly.

The weather strip and balance assembly or jamb liner 40 also mounts a sash guide member 95 intermediate the extent thereof and in the recessed center portion 47 between the ridges 44, 45. The sash guide member 95 is secured to the weather strip 42 through screws or rivets in manufacture of the assembly and serves to guide the sash in its movement on the ridges as it moves on the weather strip. It also serves to close and seal the opening in the normal overhang or flanges on the sash at the meeting line in the closed position of the sash to effect the seal at the guide openings therein, as will be seen in FIGS. 5 and 6.

The weather strip member also includes apertures 91 at the upper and lower ends of the same which are set off from the center of the recessed surface 47. The apertures have mounting members 90 for the weather strip and balance assembly positioned therethrough. Mounting members 90 have screws 92 fitted therethrough to extend through the apertures 91 and into the side jambs of the window frame to secure the weather strip and balance assemblies or jamb liners to the window frame. The mounting members are generally cylindrical in form with a recessed surface at one end which fits into the aperture 91 in the weather strip with opening therethrough for the mounting of the screw 92. This arrangement of parts permits mounting of the weather strip on the window jamb to secure the same thereto but it does not compress the weather strip completely so that flexture of the same is retained to provide the seal to the sash. These mounting members 90 also serve as sash stops. The lower mounting member is offset in the weather strip to restrict downward movement of the upper sash, and a corresponding offset mounting of the member 90 on the upper end of the sash of the window frame restricts upward movement of the sash.

The weather strip and mounting assemblies are installed in the window frame in the side jambs thereof by first positioning the assemblies against the side styles of the sash apart from the window to orient the ridges in the grooves in the sash. The entire assembly is then positioned within the window frame such that the weather strip and balance assemblies are fitted into the side jambs of the window frame. The individual jamb liners or weather strip and balance assemblies are next secured to the window frame by inserting the mounting members 90 in the apertures 91 in the weather strip and applying the screws 92 therethrough threading the same into the side jambs of the window frame at the upper and lower end of the weather strip.

In the manufacture, shipping and installation of the weather strip and balance assemblies, the sash cord 65 at the end having the anchor 80 thereon is held in position on the face of the weather strip by a throw away anchor 100. The throw away anchor 100 is a small metal or plastic piece having a semi-cylindrical body to fit over the ridges of the weather strip with a slot at one end thereof to hold the cord at the anchor end. The anchor further has a transversely extending flange 102 or platform which is adapted to bear against the base of the sash during installation. The throw away anchor 100 assures that the end of the sash cord with anchor 80 thereon is held on the face of the weather strip in a position to be connected to the sash upon installation. As the weather strip and balance assemblies are applied to the sash and installation, the throw away anchors are so positioned that the platforms thereof are positioned below and in contact with the base of the sash. After the assembly is secured in the window frame, the individual sash may be moved pulling the sash cord from the weather strip and balance assembly and permitting the removal of the anchor 100 so that the sash cord may be connected to the sash. The individual anchors 80 are connected to the base of each sash in the grooves 82 therein by first adjusting the length of the cord at the anchor to apply a proper tension to the sash from the balance assembly. Thereafter, the holes 83 may be drilled and the anchors inserted therein to secure the ends of the sash cord to the sash.

Figure 7:
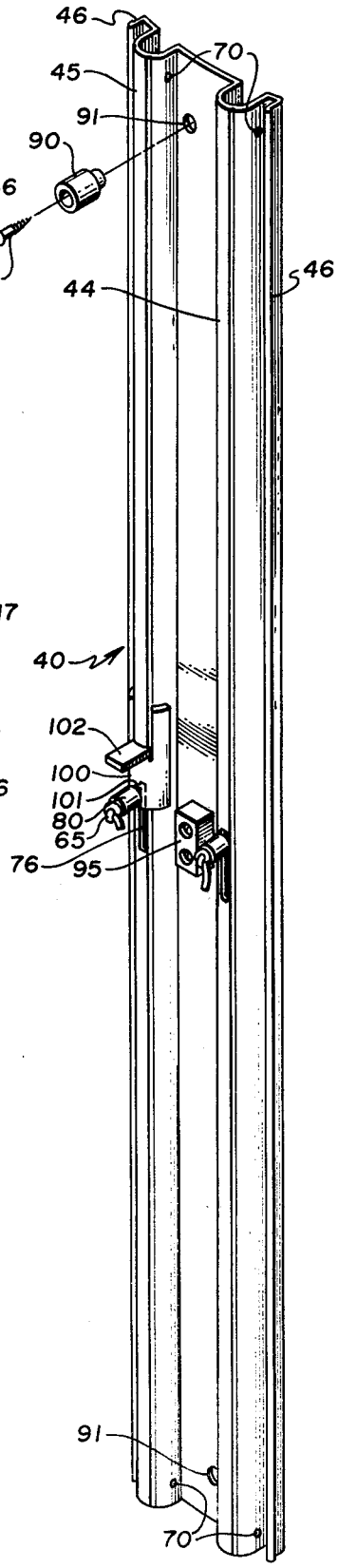

FIG. 7 shows a perspective view of the weather strip and balance assembly as it is supplied from the manufacturer and is available for use in the installation of a window frame with sash at the time the window is to be assembled. The improved weather strip and balance assembly permits the usage of any sized spring, that is, diameter or length, capable of fitting into the confines of the ridges 44, 45 of the weather strip with the springs being made of different types of material to provide different spring rates. The selection of the spring size and material will be determined by the general requirements for counterbalancing the weight of the selected sash. The length of the springs is generally not restricted since the length of the sash cord may be varied. The upper pulley blocks 64 provide the means for anchoring one end of the sash cord of each balance system. The pulleys provide the application of tension from the springs to the sash cords directing of the sash cords out of the openings 76 in the ridges 44, 45 so that the sash cords may be positioned in the grooves of the sash and may be connected to the base of the sash. The portions of the sash cord outside of the weather strip are located in the grooves 54, 55 of the sash, and they extend to the grooves 82 on the bottom of the sash where the sash cords are secured to the sash through the anchors 80.

The improved weather strip and balance assembly provides an arrangement of parts in which a minimum or no stress will be applied to the weather strip in the manufacture and shipping and storage of the same. As manufactured, a minimum of tension is applied to the sash cord and the end of the same with the anchor thereon will be secured to the face of the weather strip, as will be best seen in FIG. 7, for ease in connecting the sash thereto. If desired, the ends of the springs, normally attached to the rivets 70 at one end of the weather strip, may be removed from the rivets for shipment and reconnected whenever the weather strip and balance assembly is to be mounted in the window frame. The size of the ridges in the weather strip which mount the sash are such that the springs and pulleys mounted therein will not protrude from the curved base to interfere with compressability of the weather strip as it is installed and in use in sealing to the edges of the sash. Further, the bowed and flexible configuration of the weather strip permits not only compressive but slight translational movement to insure a positive seal of the weather strip to the side styles of the sash in installation. The bent edges 46 of the weather strip fit around the faces of the sash for decorative purposes and to further insure a seal at these points. The improved design of the weather strip and balance assembly is such as to permit an interchange of springs without altering the configuration and operation of the same.

In considering this invention it should be remembered that the present description is illustrative only and the scope of the invention should be determined by the appended claims.

What I claim is:

1. A weather strip and balance assembly for a nonremovable window having a window frame with side jambs and at least one sash positioned in the frame on said side jambs; comprising:

(a) a pair of side jamb liners adapted to mount a sash on the side jambs of the window frame, said side jamb liners each being formed of a weather strip and a balance assembly mounted thereon;

(b) said weather strip being formed of a piece of flexible material of a length and width dimension to fit the jamb and having a pair of spaced outwardly extending ridges with a recessed center portion therebetween extending the full length of the same and with the weather strip being bowed outwardly along its width to slidably mount and seal to the sides of a sash at the ridges of the weather strip;

(c) the balance assembly for each jamb liner being formed of a spring positioned in one of the ridges and secured at one end to the ridge with a first pulley secured to said one ridge at its opposite end, a second pulley mounted on an end of the spring in said ridge remote from said one end, and a sash cord secured to the weather strip in said one ridge and directed over and between said pulleys;

(d) a slot in said one ridge of the weather strip intermediate the length of the same receiving and guiding the end of the sash cord from within said ridge to permit connection to a sash positioned on the surface of the ridge;

(e) and means connected to the free end of the sash cord outside of the ridge for connecting the sash cord to a sash positioned on the ridge.

2. The weather strip and balance assembly of claim 1 in which the spaced outwardly extending ridges on the weather strip extend the length of the weather strip parallel to one another and are movable generally normal to the width of the weather strip with compression of the same and translationally in the mounting and sealing to a sash.

3. The weather strip and balance assembly of claim 2 in which the weather strip includes bent edges projecting in the direction of the ridges and extending along the length of the same, said edges being adapted to mount and cover the sides of a sash when a sash is mounted on the weather strip.

4. The weather strip and balance assembly of claim 1 in which the jamb liners have balance assemblies positioned in each of the ridges thereon which are adapted to connect to and counterbalance a pair of sash slidably mounted thereon.

5. The weather strip and balance assembly of claim 1 in which the spring and first named pulley of each balance assembly are secured respectively at opposite ends of the weather strip within the ridges by rivets extending through the sides of the ridges of the weather strip.

6. The weather strip and balance assembly of claim 1 in which the weather strip is made of a high impact, semi-rigid polyvinyl material.

7. The weather strip and balance assembly of claim 1 in which the weather strip is made of a thin flexible metal material.

8. The weather strip and balance assembly of claim 1 and including aperture means positioned in the recessed center portion of the weather strip at opposite ends thereof for mounting the jamb liners on the side jambs of the window frame.

9. The weather strip and balance assembly of claim 8 and including mounting blocks having recessed end portions adapted to fit through the aperture means in the weather strip to mount the jamb liner on the side jambs of the window frame with the weather strip in a slightly bowed condition for flexure of the same.

10. The weather strip and balance assembly of claim 9 and including guide blocks mounted on the weather strip in the recessed center portion intermediate the length of the weather strip and adapted to guide the sash and seal the sash in a closed position in the window frame.

11. The weather strip and balance assembly of claim 10 in which the mounting blocks positioned in the apertures in the weather strip are positioned off center in the recessed center portion to serve as stop means for sash mounted on the weather strip.

12. The weather strip and balance assembly of claim 1 in which the means connected to the free end of the sash cord outside of the ridges includes means for retaining said end of said sash cord outside of said ridge.

13. The weather strip and balance assembly of claim 12 in which said last named means includes a throwaway anchor member shaped to fit over the ridge of the weather strip and secure the end of the sash cord thereto and having a flange adapted to engage the sash for withdrawing the sash cord from the slot in the jamb liner upon installation and connection of the sash cord to the sash.

14. A weather strip and balance assembly for a nonremovable window having a window frame with side jambs and a pair of sash positioned on the side jambs in the frame comprising: a pair of side jamb liners adapted to mount the sash on the side jambs of the window frame, said side jamb liners each being formed of a weather strip with balance assemblies mounted thereon; each weather strip being formed of a piece of flexible material having a length and width dimension to fit the jamb of the window frame and having a pair of spaced outwardly extending ridges with a recessed center portion therebetween extending the length of the weather strip, the weather strip further being bowed outwardly along its width to slidably mount and seal to the sides of a sash at the ridges of the weather strip; the balance assemblies each being formed of a spring means with a sash cord connected thereto and guide means for directing the sash cord such as to apply a tension to a sash, each balance assembly being positioned solely within one of the ridges with each spring secured to the ridge at one end of the weather strip and a guide means secured to the ridge at the opposite end of the weather strip; each sash cord being directed out of the ridge through a slot in its ridge intermediate the length thereof; and means connected to the free end of each of the sash cords outside of the ridges for connecting the sash cords to sash adapted to be positioned on the ridges.

15. The weather strip and balance assembly of claim 14 in which the means connected to the free end of a sash cord outside of the ridge includes means for retaining said end of said sash cord outside of said ridge.

16. The weather strip and balance assembly of claim 15 in which the last named means include a throwaway anchor member shaped to fit over the ridge of the weather strip and secure the end of the sash cord thereto and having a flange adapted to engage the sash for withdrawing the sash cord from the slot in the jamb liner upon installation and connection of the sash cord to a sash.

* * * * *

UNITED STATES PATENT AND TRADEMARK OFFICE

CERTIFICATE OF CORRECTION

PATENT NO. : 4,134,234

DATED : January 16, 1979

INVENTOR(S) : Edward H. Wood

It is certified that error appears in the above-identified patent and that said Letters Patent are hereby corrected as shown below:

IN THE ABSTRACT

Line 13, delete "said" and insert --side--.

Column 2, line 12, delete "FIG. 1" and insert --the Figures--.

Column 2, line 25, delete "liner" and insert --liners--.

Column 2, line 45, delete "ridge." and insert --ridge,--.

Signed and Sealed this

*Thirty-first* Day of *July 1979*

[SEAL]

*Attest:*

*Attesting Officer*

LUTRELLE F. PARKER

*Acting Commissioner of Patents and Trademarks*